US007654202B2

(12) United States Patent
Romero

(10) Patent No.: US 7,654,202 B2
(45) Date of Patent: Feb. 2, 2010

(54) FRANGIBLE SLUG

(75) Inventor: Michael A. Romero, Edgemont, SD (US)

(73) Assignee: Stresau West, Inc., Edgemont, SD (US)

( * ) Notice: Subject to any disclaimer, the term of this patent is extended or adjusted under 35 U.S.C. 154(b) by 514 days.

(21) Appl. No.: 11/347,031

(22) Filed: Feb. 3, 2006

(65) Prior Publication Data

US 2007/0181031 A1 Aug. 9, 2007

(51) Int. Cl.
*F42B 30/02* (2006.01)

(52) U.S. Cl. ..... 102/517; 102/516; 102/438; 102/439

(58) Field of Classification Search ..... 86/42; 102/498, 438, 439, 517, 518, 516
See application file for complete search history.

(56) References Cited

U.S. PATENT DOCUMENTS

| | | | | |
|---|---|---|---|---|
| 1,953,904 | A * | 4/1934 | Jacobs et al. | 102/430 |
| 2,292,047 | A * | 8/1942 | Calhoun | 102/511 |
| 3,031,966 | A * | 5/1962 | Metzger | 102/444 |
| 4,365,559 | A * | 12/1982 | Gruaz | 102/439 |
| 4,942,818 | A * | 7/1990 | Saxby | 102/444 |
| 5,035,183 | A * | 7/1991 | Luxton | 102/502 |
| 5,183,963 | A * | 2/1993 | Beaufils et al. | 102/515 |
| 5,225,628 | A * | 7/1993 | Heiny | 102/438 |
| 6,067,909 | A * | 5/2000 | Knoster, Jr. | 102/517 |
| 6,182,574 | B1 * | 2/2001 | Giannoni | 102/516 |
| 6,263,798 | B1 | 7/2001 | Benini | |
| 6,443,069 | B2 * | 9/2002 | Proffitt | 102/444 |
| 6,536,352 | B1 | 3/2003 | Nadkarni et al. | |
| 6,899,034 | B1 * | 5/2005 | Glover et al. | 102/457 |
| 2001/0007228 | A1 * | 7/2001 | Proffitt | 102/444 |
| 2003/0101891 | A1 * | 6/2003 | Amick | 102/514 |

FOREIGN PATENT DOCUMENTS

| | | |
|---|---|---|
| EP | 0315 393 | 10/1988 |
| GB | 2357137 | 12/1999 |
| WO | WO 99/08063 | 2/1999 |

OTHER PUBLICATIONS

Sage International, Ltd, Weapons Accessories, Heavy 12ga. Door Breaching Ammunition, http://sageinternationalltd.com/si/wepacc/wepacc.html, Jan. 27, 2006, pp. 1-8.

(Continued)

*Primary Examiner*—Michael Carone
*Assistant Examiner*—Jonathan C Weber
(74) *Attorney, Agent, or Firm*—Brooks, Cameron & Huebsch, PLLC

(57) ABSTRACT

Methods and articles are provided for frangible slugs. A method of manufacturing a frangible slug includes heating substantially spherical metallic powdered particles, wherein substantially all of the powdered particles have diameters larger than 125 microns and smaller than 250 microns, to form heated powdered particles. The method includes heating a microcrystalline wax, to form a melted wax. The method also includes combining the heated powdered particles with the melted wax, to form a liquid mixture. The method further includes filling a payload cavity of a frangible slug container with the liquid mixture to form a liquid mixture payload.

20 Claims, 7 Drawing Sheets

OTHER PUBLICATIONS

PMC (Precision Made Cartridges), Shothsell Ballistics, Law Enforcement Shotshells, http://pmcammo.com/shotshell_ballistics.php, Jan. 27, 2006, pp. 1-5.

TSSI (Tactical & Survival Specialists, Inc.), 12ga TKO Breaching Round, http://www.tacsurv.com/TSSIPortal/DesktopDefault.aspx?tabid=5841, Jan. 27, 2006 pp. 1-3.

A.L.S. Technologies, Door/Lock Breacher 12 gauge, http://www.alstechnologies.com/products/cat9.htm, Jan. 27, 2006, pp. 1-2.

Adam Geibel, "The Shotgun Approach", Special Operations Technology Online Edition, Dec. 14, 2005, vol. 3, No. 8, http://www.special-operations-technology.com/article.cfm?DocID491.

* cited by examiner

FRANGIBLE SLUG

BACKGROUND

In the field of ordnance, various types of cartridges are available for firearms. A cartridge is a piece of ammunition that contains primer, propellant, and a ballistic projectile, packaged together in a case. Cartridges are sometimes referred to as rounds or shells, with cartridges for shotguns referred to as shotgun shells.

Cartridges are available with several types of ballistic projectiles. One well-known type of ballistic projectile is a bullet, which is a solid projectile mounted in or on the front end of a cartridge. A bullet is sometimes referred to as a slug, as described below.

Shotgun shells are typically available with shot or slugs as ballistic projectiles. Shot are small solid round projectiles, which are packed into the front end of a shotgun shell. Shot are available in various sizes, from small birdshot (size 9 birdshot is 0.080" in diameter) to large buckshot (size 000 buckshot is 0.36" in diameter). A shotgun shell with shot typically includes a number of shot, with the number depending on the size of the shot and the size of the shotgun shell.

A slug is a projectile package mounted in or on the front end of a cartridge, such as a shotgun shell. A slug can be a solid projectile package, such as a bullet. Alternatively, a slug can be a composite projectile package formed from one or more component parts and/or materials, such as a container and a payload.

Various types of slugs are available for firearm applications. One firearm application is the disabling of door hardware. Sometimes, military and/or law enforcement personnel may use firearms to disable the hardware of a door in order to gain entrance into a building. In this application, a firearm can be used to fire a door slug at door hardware, such as a handle, lock, or hinge, to disable the door hardware. Throughout this document, a slug intended to disable door hardware is referred to as a door slug.

A door slug can effectively disable door hardware in several ways. One way in which a door slug can disable door hardware is by removing a portion of a door and/or door frame, to which the door hardware is connected. Another way in which a door slug can disable door hardware is by removing a portion or all of the door hardware from a door and/or door frame to which the door hardware is connected. Still another way in which a door slug can disable door hardware is by damaging it so that it no longer performs its intended function. Alternatively, a door slug can effectively disable door hardware by using a combination of these ways.

Some door slugs, when fired at door hardware, may fail to effectively disable the door hardware. A door slug may impact the door hardware but fail to effectively disable it. Alternatively, a door slug may pass through a portion of the door hardware but still fail to effectively disable it.

Some door slugs, when fired at door hardware, may perform poorly upon impact with door hardware. A portion or all of a door slug may pass through the door hardware, possibly harming a person behind the door. A portion or all of the door slug may ricochet off the door hardware, possibly harming a person who fired the door slug. The impact of the door slug may cause pieces of the door hardware to fragment and fly off at high speeds, possibly harming a person in the vicinity of the impact.

DETAILED DESCRIPTION

The present disclosure includes method and article embodiments for frangible slugs. For example, a method of manufacturing a frangible slug includes heating substantially spherical metallic powdered particles, wherein substantially all of the powdered particles have diameters larger than 125 microns and smaller than 250 microns, to form heated powdered particles. The method includes heating a microcrystalline wax, to form a melted wax. The method also includes combining the heated powdered particles with the melted wax, to form a liquid mixture. The method further includes filling a payload cavity of a frangible slug container with the liquid mixture to form a liquid mixture payload.

Embodiments of a frangible slug of the present disclosure can be used as door slugs. Throughout this document, use of a frangible slug of the present disclosure refers to use as a door slug, unless otherwise indicated. However, a frangible slug of the present disclosure may also be suitable for use in other firearm applications, as will be understood by one of ordinary skill in the art. When used as a door slug, a frangible slug of the present disclosure performs properly upon impact with door hardware and effectively disables the door hardware.

When a frangible slug of the present disclosure is fired at door hardware, the frangible slug substantially disintegrates as it impacts the door hardware. The impact imparts much of the slug's kinetic energy to the door hardware, effectively disabling it. The substantial disintegration reduces the possibility that the frangible slug will ricochet. The substantial disintegration also reduces the possibility that pieces of the door hardware will fragment and fly off. Thus, a frangible slug of the present disclosure performs properly upon impact and effectively disables door hardware.

Figure 1A:
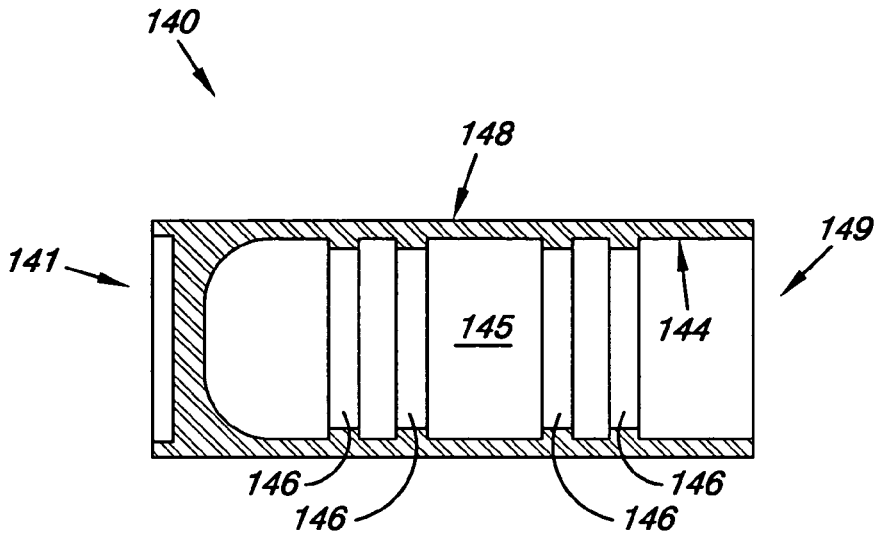
FIG. 1A illustrates a side view of an empty frangible slug container according to embodiments of the present disclosure.

FIG. 1A illustrates a side view of an empty frangible slug container 140 according to embodiments of the present disclosure. FIG. 1A illustrates a cross-sectional view. The frangible slug container 140 includes a back end 141, an inside surface 144, a payload cavity 145, ribs 146, an outside surface 148, and a front end 149.

The frangible slug container 140 is substantially cylindrical with a smooth outside surface 148. Most firearm cartridges have hollow cylindrical cases configured to incorporate a cylindrical slug with a smooth outside surface.

The cylindrical shape and the smooth outside surface 148 of the frangible slug container 140 allow it to be incorporated into a cylindrical firearm cartridge. However, a frangible slug container of the present disclosure can have various other shapes, such as a square shape for a square cartridge.

The frangible slug container 140 includes a closed end and an open end. The back end 141 is closed and is configured to face toward a base of a firearm cartridge. In the embodiment of FIG. 1, the back end 141 of the frangible slug container 140 includes a recessed portion, which can be used for mating the back end 141 with a front face of a gas seal when assembled in a cartridge, as described in connection with FIG. 2. In various embodiments, a back end can have various recesses or protrusions or it can be a flat surface, depending upon various criteria, such as the configuration of other cartridge components. The front end 149 is open and is configured to face toward a front end of a firearm cartridge, as described in connection with FIG. 1C.

A payload cavity can be defined by various parts of a frangible slug container. The payload cavity 145 is defined in part by the inside surface 144, which includes an inside of the wall that forms the cylindrical shape of the frangible slug container 140. The inside surface 144 also includes surfaces of the ribs 146 and an inside of the back end 141 of the frangible slug container 140. The payload cavity 145 is also defined in part by a rim formed by the wall of the frangible slug container 140 at the front end 149. Embodiments of the present disclosure can include a payload cavity of various sizes and/or shapes.

The inside surface 144 includes four ribs 146. In the embodiment of FIG. 1, each of the four ribs 146 uniformly protrudes out from the inside of the wall of the frangible slug container 140. Each of the four ribs 146 extends around the circumference of the inside wall. However, the ribs 146 in the embodiment of FIG. 1 are shown for illustrative purposes and are not intended to limit embodiments of the present disclosure to any particular size, shape, orientation, configuration, or number of ribs.

In various embodiments, an inside surface of a frangible slug container 140 can include numerous variations of ribs. For example, a rib can be configured as a recess in the inside wall. Also as an example, a rib can have a triangular shape. As a further example, a rib can be oriented from a back end to a front end of a frangible slug container. The ribs 146 can be configured to perform various functions, as described in connection with FIG. 1C. Various embodiments of ribs can be used to accomplish such functions, as will be understood by one of ordinary skill in the art.

Figure 1B:
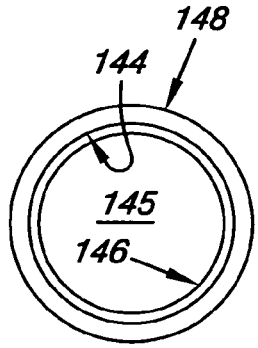
FIG. 1B illustrates an end view of an empty frangible slug container according to embodiments of the present disclosure.
Figure 1C:
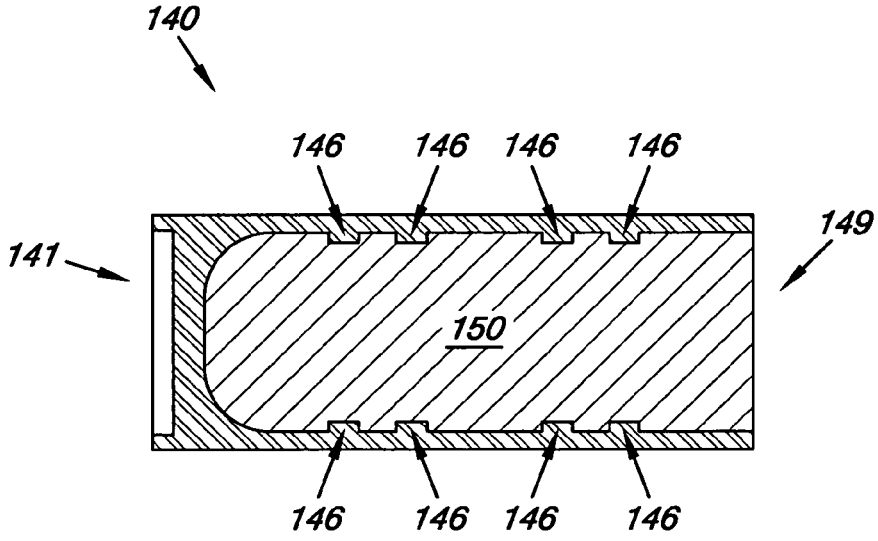
FIG. 1C illustrates a side view of a filled frangible slug container according to embodiments of the present disclosure.

FIG. 1B illustrates an end view of the empty frangible slug container 140 according to embodiments of the present disclosure. FIG. 1B illustrates an end view from the front end 149. As shown in the embodiment of FIG. 1B, the frangible slug container 140 includes an inside surface 144, a payload cavity 145, ribs 146, and an outside surface 148. The payload cavity 145 is shown empty in FIG. 1B.

The frangible slug container 140 can be formed from various materials in various ways. The frangible slug container 140 can be formed from various rigid materials, such as thermosets, thermoplastics, ceramics, and metals, as will be understood by one of ordinary skill in the art. The frangible slug container 140 can be formed in various ways, such as casting, molding, and machining, as will also be understood by one of ordinary skill in the art. As an example, a frangible slug container of the present disclosure can formed from high-density polyethylene by using a molding process.

FIG. 1C illustrates a side view of a filled frangible slug container 140 according to embodiments of the present disclosure. The filled frangible slug container 140 is a composite projectile package, which includes the frangible slug container 140 filled with a frangible payload 150. Accordingly, the filled frangible slug container 140 is considered a slug. In various embodiments of the present disclosure, a frangible slug container may or may not be frangible. However, for ease of reference, throughout this document, a frangible slug container filled with a frangible payload is referred to as a frangible slug.

FIG. 1C illustrates a cross-sectional view of the frangible slug 140, including the back end 141, the ribs 146, the front end 149 and the frangible payload 150. The frangible slug container contains the frangible payload 150 inside the payload cavity 145 (shown in connection with FIG. 1A). The frangible slug container 140 can be filled with the frangible payload 150 as described in connection with FIGS. 3-4. The frangible payload 150 can be a solid mixture, configured to substantially disintegrate as it impacts a stationary solid object, such as door hardware. The solid mixture is described in connection with FIGS. 3A-3D. As a result, the frangible slug 140 can be used as a door slug.

In the embodiment of FIG. 1C, the frangible payload 150 fills all of the payload cavity 145 of the frangible slug container. However, in various embodiments, a frangible payload can fill less than all of a payload cavity of a frangible slug container. The frangible payload 150 contacts the inside of the back end 141 as well as the inside of the wall that forms the cylindrical shape of the frangible slug container. The frangible payload 150 also contacts and conforms to the ribs 146. The frangible payload 150 is exposed on an open end of the frangible slug container at the front end 149.

The frangible slug 140 can be incorporated into a firearm cartridge, for use as a door slug. Such a cartridge is described further in connection with FIG. 2. When the frangible slug 140 is incorporated into a firearm cartridge and fired with a firearm, various features of the frangible slug 140 allow it to perform properly upon impact with door hardware and effectively disable the door hardware. The performance of the frangible slug 140 upon impact can be affected by performance of the frangible slug 140 when fired and while traveling to the door hardware. Thus, various features of the frangible slug 140 also allow it to perform properly when fired and while traveling.

The frangible slug container of the frangible slug 140 can be configured to mechanically contain and retain the frangible payload 150 inside the payload cavity 145 when it is fired. When a slug is fired, it is subjected to a firing force from exploding propellant in a base of a cartridge. The firing force rapidly accelerates the slug away from the base of the cartridge. The firing force also tends to compress the slug toward its back end. Since the back end 141 of the frangible slug 140 is closed, the frangible slug container can contain the frangible payload 150 inside the payload cavity 145 when the frangible slug 140 is fired, even though the frangible payload 150 may be compressed toward the back end 141.

The firing force can also vibrate the slug. Since the frangible payload 150 contacts and conforms to the ribs 146, the frangible slug container can retain the frangible payload 150 inside the payload cavity 145 when the frangible slug 140 is fired, even though the frangible slug container and the frangible payload 150 may be vibrated by the firing force.

The frangible slug container of the frangible slug 140 can also be configured to mechanically contain and retain the frangible payload 150 inside the payload cavity 145 after it is fired and while it is traveling to door hardware. When a slug is fired from a firearm, it travels down a barrel of the firearm and out of the barrel. As the slug passes down the barrel and out of the barrel it travels through air, which creates a drag force on the slug. Most of the drag force tends to tear at an outside of the slug as it travels through the air. Since the outside surface 148 of the frangible slug container forms an outside of the frangible slug 140, the frangible slug container can shield the payload 150 from most of the drag force and contain the frangible payload 150 inside the payload cavity 145 while the frangible slug 140 is traveling to door hardware.

The drag force can also vibrate the slug. Since the frangible payload 150 contacts and conforms to the ribs 146, the frangible slug container can retain the frangible payload 150 inside the payload cavity 145 while the frangible slug 140 is traveling to door hardware, even though the frangible slug container and the frangible payload 150 may be vibrated by the drag force.

Since the frangible slug container of the frangible slug 140 can be configured to mechanically contain and retain the frangible payload 150 inside the payload cavity 145 after it is fired and while it is traveling to door hardware, the frangible payload 150 can be contained inside the payload cavity 145 when the frangible slug 140 first begins its impact with the door hardware.

The frangible slug container can also be configured to separate from the frangible payload 150 when the frangible slug 140 impacts a stationary solid object, such as a door, a door frame, and/or door hardware. When a slug fired from a firearm impacts a stationary solid object, the slug imparts an impact force to the object and the object imparts a reaction force to the slug. The frangible slug container can be configured to separate from the frangible payload 150 when the frangible slug 140 experiences such an impact. In this embodiment, the reaction force can overcome the ability of the frangible slug container to mechanically contain and retain the frangible payload 150. Upon impact, the frangible slug container can discontinue containing and retaining the frangible payload 150, separating from the frangible payload 150. After this separation, since the front end 149 of the frangible slug container is open, the frangible payload 150 can travel on, passing through the open end, exiting the frangible slug container, and impacting the object. As a result, the frangible payload 150 can impact the object without restraint from the frangible slug container.

The containing, retaining, and separating, discussed above, can allow the frangible payload 150 to substantially disintegrate over a relatively small area as it impacts a stationary solid object, such as door hardware. For example, in various embodiments, a frangible payload can be configured to substantially disintegrate over an area less than 2 inches in diameter. Since the frangible payload 150 can substantially disintegrate over a relatively small area upon impact, the frangible payload can impart much of its kinetic energy over a small area, such as door hardware. As a result, the frangible slug 140 can be used as a door slug to effectively disable door hardware. The frangible slug 140 can be incorporated into a firearm cartridge, as described in connection with FIG. 2.

Figure 2:
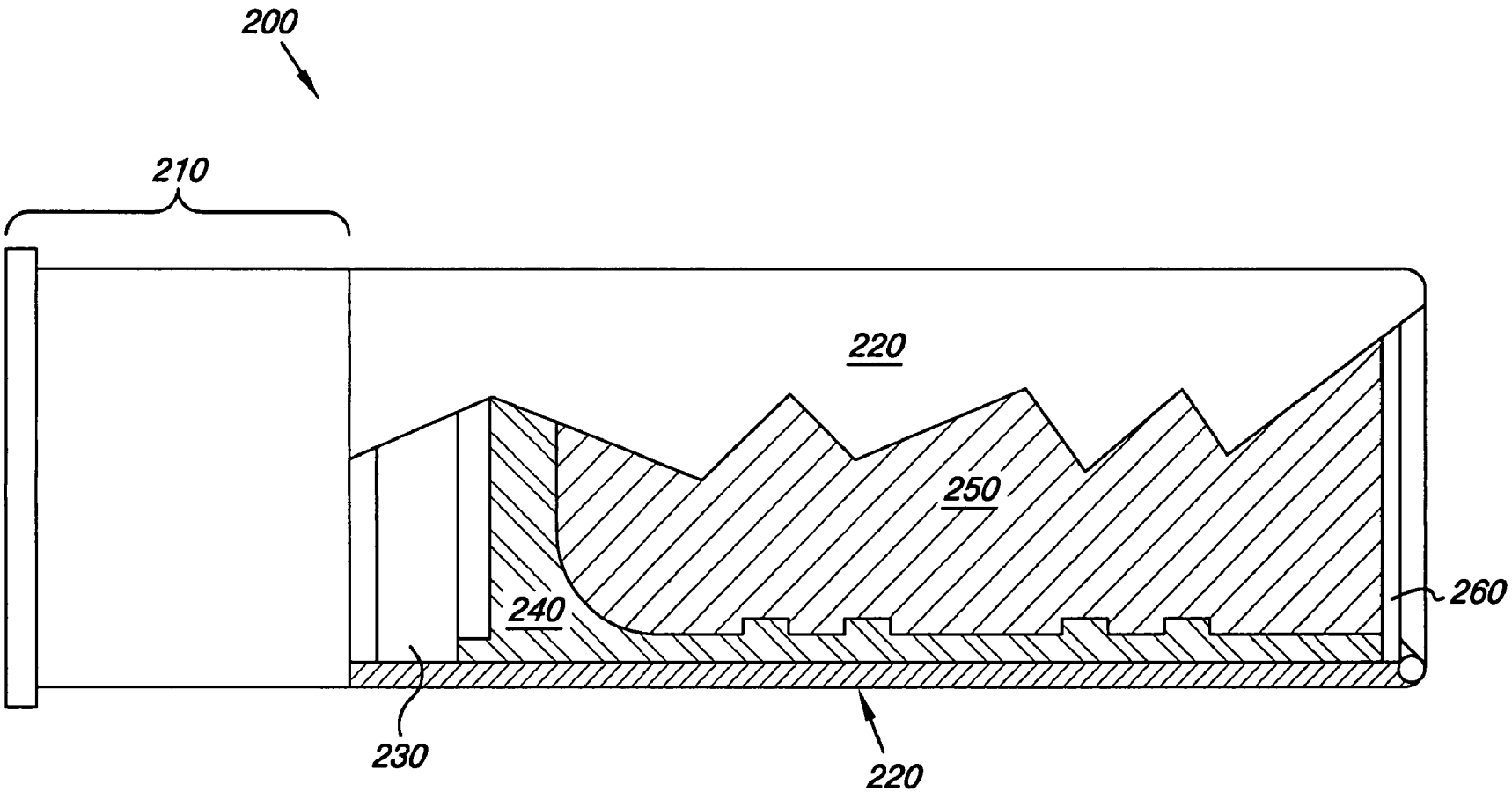
FIG. 2 illustrates a side view of a firearm cartridge with a frangible slug according to embodiments of the present disclosure.

FIG. 2 illustrates a side view of a firearm cartridge 200 with a frangible slug according to embodiments of the present disclosure. The firearm cartridge 200 includes a base 210, a case 220, a gas seal 230, a frangible slug container 240, a frangible payload 250, and an overshot card 260. The base 210 of the firearm cartridge contains primer and propellant. The primer, the propellant, the case 220, the gas seal 230, and the overshot card 260 can be commercially available cartridge components, manufactured by using various methods as will be understood by one of ordinary skill in the art. The firearm cartridge 200 can be assembled using various cartridge assembly techniques, as will also be understood by one of ordinary skill in the art.

The frangible slug container 240, together with the frangible payload 250, is considered a frangible slug, as described in connection with FIG. 1C. The frangible slug container 240 can be configured to contain the frangible payload 250 from a firing of the firearm cartridge 200, until the frangible slug impacts a stationary solid object, such as door hardware. The frangible slug container 240 can also be configured to separate from the frangible payload 250 upon such an impact. The frangible payload 250 can be configured to substantially disintegrate over a relatively small area as it impacts a stationary solid object, such as door hardware. In various embodiments, the frangible slug of FIG. 2 can be the frangible slug of FIG. 1C.

The components of the firearm cartridge 200 perform various functions when the firearm cartridge 200 is fired with a firearm. When the firearm cartridge 200 is fired, the primer ignites the propellant (e.g. gunpowder) in the base 210. The ignited propellant explodes, providing a firing force, which is imparted to the frangible slug through the gas seal 230. The firing force rapidly accelerates the frangible slug away from the base 210 to a particular muzzle velocity. When the frangible slug impacts a stationary solid object, such as door hardware, at a velocity that is substantially equal to the particular muzzle velocity, the frangible payload 250 can substantially disintegrate. As a result, the frangible slug of the firearm cartridge 200 can perform properly upon impact and effectively disable door hardware.

FIG. 2 is intended to illustrate a frangible slug incorporated into a firearm cartridge, and is not intended to limit embodiments of the present disclosure to any particular size, type, or configuration of cartridge. In various embodiments, the firearm cartridge 200 can be configured as rimmed or rimless, centerfire or rimfire, for shotguns, rifles, handguns, or other firearms of various standard or specialty calibers. For example, a firearm cartridge with a frangible slug of the present disclosure can be configured as a shotgun shell for a twelve gauge shotgun.

Figure 3A:
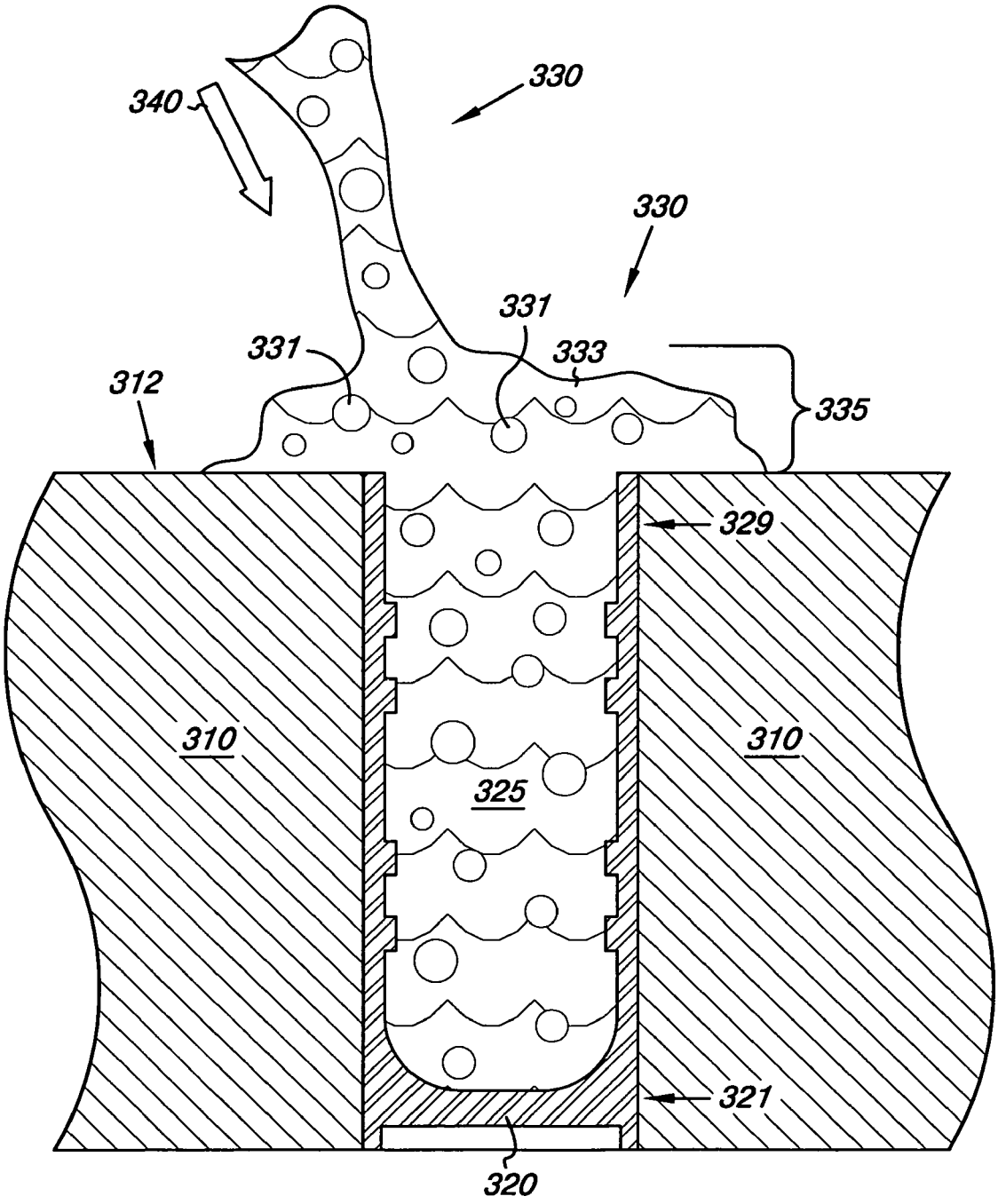
FIG. 3A illustrates a method of overfilling a frangible slug container according to embodiments of the present disclosure.
Figure 3B:
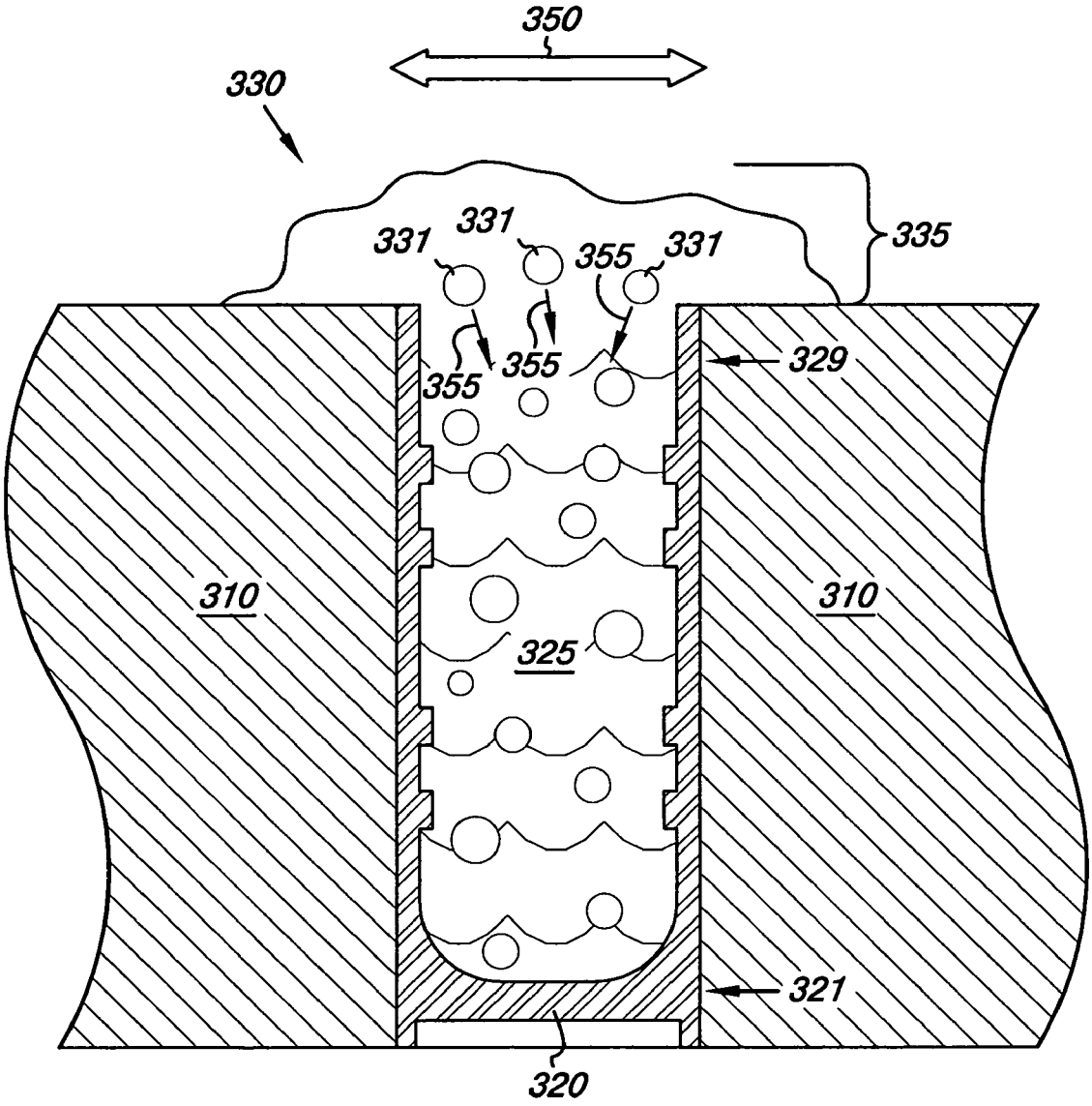
FIG. 3B illustrates a method of settling powdered particles into a frangible slug container according to embodiments of the present disclosure.
Figure 3C:
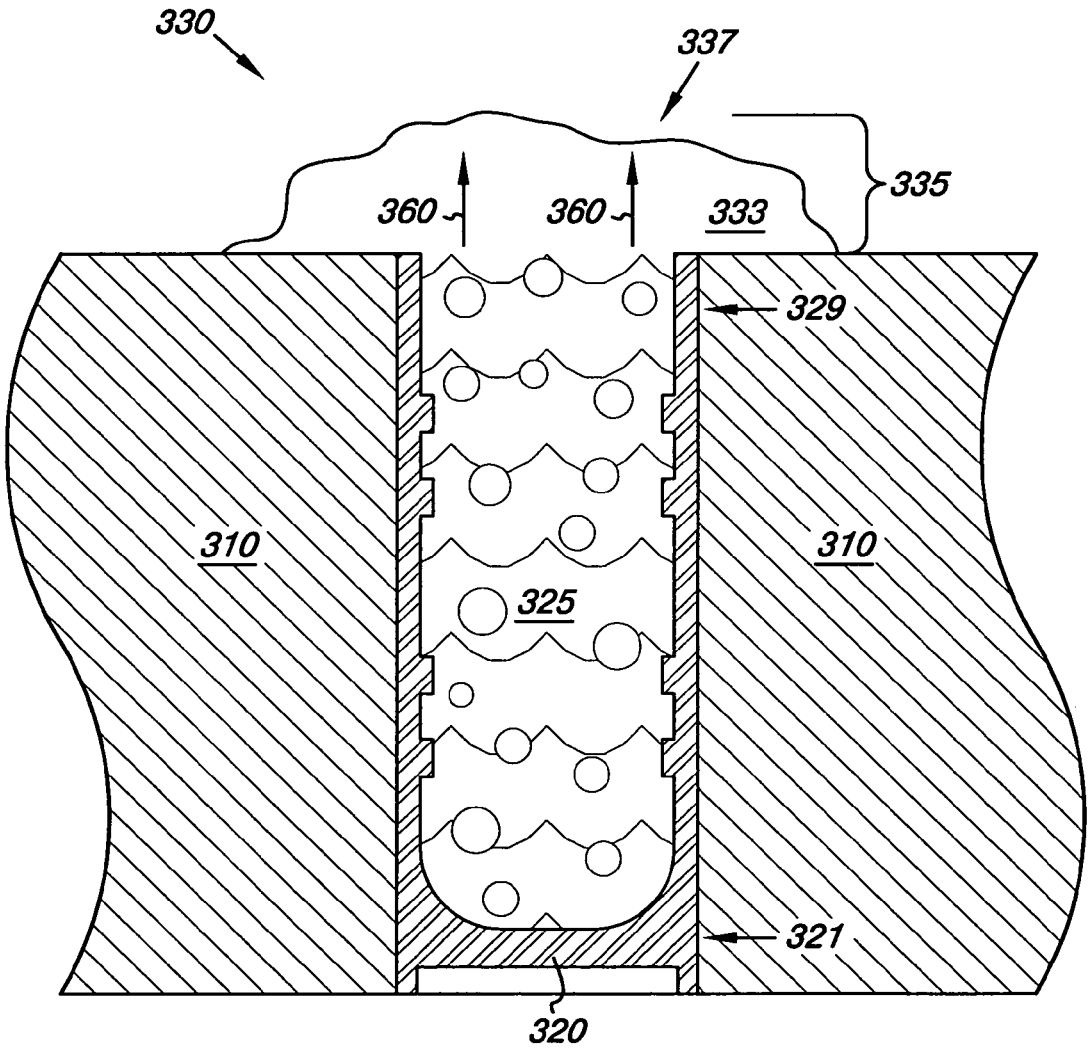
FIG. 3C illustrates a method of floating excess binder from a frangible slug container according to embodiments of the present disclosure.
Figure 3D:
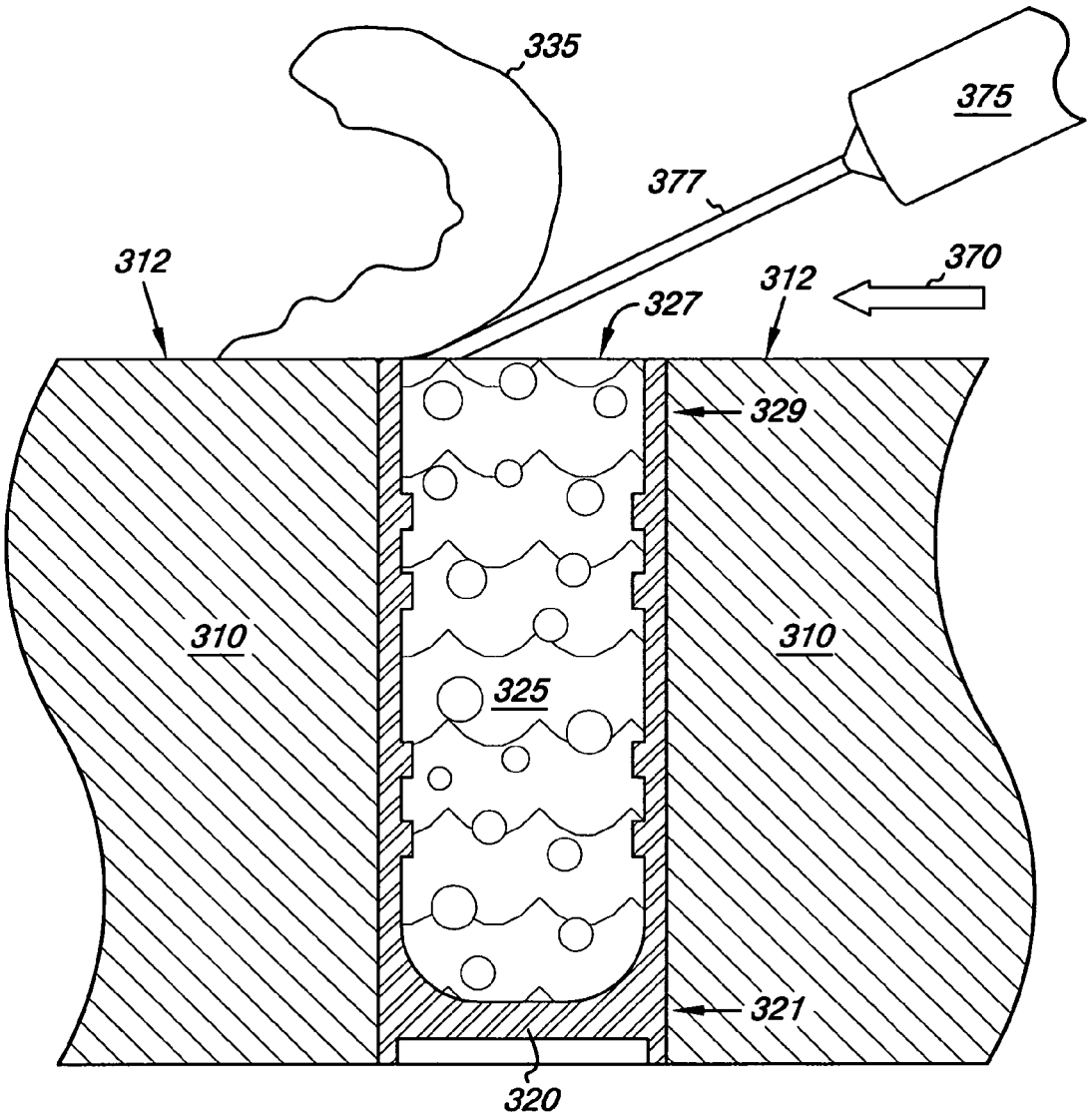
FIG. 3D illustrates a method of removing overfill from a frangible slug container according to embodiments of the present disclosure.
Figure 4:
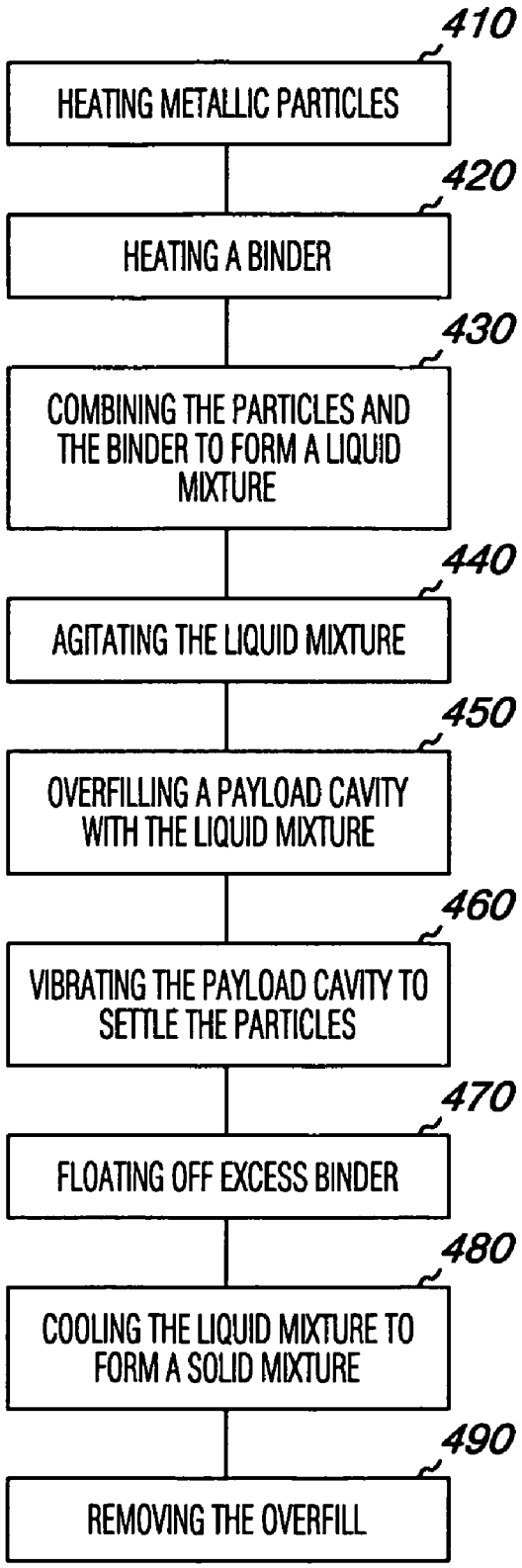
FIG. 4 illustrates a method of manufacturing a frangible slug according to embodiments of the present disclosure.

FIGS. 3-4 illustrate method embodiments of the present disclosure. Unless explicitly stated, the method embodiments or elements thereof that are described herein are not constrained to a particular order or sequence. Additionally, some of the described method embodiments or elements thereof can occur or be performed at the same point in time. FIGS. 3A-3D illustrate methods that can be used in manufacturing a frangible slug according to embodiments of the present disclosure. FIGS. 3A-3D are intended to illustrate general properties of various materials as methods are performed. However, FIGS. 3A-3D are not intended to represent actual sizes, shapes, scales, or distributions of such materials.

FIG. 3A illustrates a method of overfilling a frangible slug container 320 according to embodiments of the present disclosure. FIG. 3A illustrates a cross-sectional view. The illustration of FIG. 3A includes a tooling 310 holding the frangible slug container 320 and a liquid mixture 330 being poured 340 into the frangible slug container 320. The tooling 310 includes a top surface 312. The frangible slug container 320 includes a bottom 321, a payload cavity 325, and a top 329. The liquid mixture 330 includes powdered particles 331 and a binder 333. The liquid mixture 330 can overfill the payload cavity 325 creating an overfill 335 above the payload cavity 325 and on the top surface 312.

The powdered particles 331 in the liquid mixture 330 can be substantially spherical powdered particles. The substantially spherical shape can allow the powdered particles 331 to flow past each other in the liquid mixture 330 without interlocking with each other. The substantially spherical shape of the powdered particles 331 can also allow them to closely pack together in the liquid mixture 330. When cooled, the liquid mixture 330 can form a solid mixture that can be used as a frangible payload, as described in connection with FIG. 3D. The substantially spherical shape of the powdered particles 331 can allow the solid mixture to fracture with numerous clean breaks, so a frangible payload formed from the solid mixture can substantially disintegrate when it impacts a stationary solid object, as described in connection with FIG. 1C.

The powdered particles 331 in the liquid mixture 330 can be metallic powdered particles. Various metals and/or metal alloys can be used for the powdered particles 331. Such metals can include copper, iron, lead, and zinc, and such metal alloys can include bronze, brass, and steel, among others. As an example, the powdered particles 331 can be mild carbon steel, formed with iron and low amounts of carbon, such as C1018 steel, which is formed with 98.2% iron and 1.8% carbon.

In various embodiments of the liquid mixture 330, substantially all of the powdered particles 331 can have diameters larger than 125 microns and smaller than 250 microns. Various sieving and/or screening methods can be used to obtain powdered particles with a particular range of diameters, as will be understood by one of ordinary skill in the art. For example, powdered particles can be screened through a 60 mesh US Standard screen, which has 250 micron openings, retaining powdered particles larger than 250 microns in diameter and passing through powdered particles smaller than 250 microns in diameter. In this example, the powdered particles smaller than 250 microns in diameter can be screened through a 120 mesh US Standard screen, which has 125 micron openings, passing through powdered particles smaller than 125 microns in diameter and retaining powdered particles larger than 125 microns in diameter, including the powdered particles smaller than 250 microns in diameter. Thus, these two screenings can be used to obtain powdered particles that have diameters larger than 125 microns and smaller than 250 microns. When the liquid mixture forms a solid mixture, these diameters of the powdered particles 331 can allow a frangible payload formed from the solid mixture to substantially disintegrate when it impacts a stationary solid object, as described in connection with FIG. 1C.

Various binders can be used as the binder 333 in the liquid mixture 330. In various embodiments, the binder 333 can be a cement, epoxy, polymer, resin, or wax, among others. For example, a binder in the liquid mixture 330 can be a petroleum-based microcrystalline wax. The binder 333 can have various physical properties, such as a melt point. As an example, a binder in the liquid mixture 330 can have a drop melt point of 170 degrees Fahrenheit. In this example, when the liquid mixture forms a solid mixture in a frangible payload, the frangible payload can remain in solid form without melting at temperatures below 170 degrees Fahrenheit. In various embodiments, a binder in the liquid mixture 330 can have a melt point from 160 to 200 degrees Fahrenheit.

The binder 333 can perform various functions in the liquid mixture 330 and in a solid mixture formed from the liquid mixture 330. In the liquid mixture 330, the binder 333 can bind the powdered particles 331 together in a common medium. In the solid mixture, the binder 333 can allow the solid mixture to fracture between the powdered particles 331, so a frangible payload formed from the solid mixture can substantially disintegrate when it impacts a stationary solid object, as described in connection with FIG. 1C.

The liquid mixture 330 can be formed by heating the powdered particles 331, heating the binder 333 until it melts, and combining the heated powdered particles 331 with the melted binder 333. In various embodiments, the powdered particles 331 and the binder 333 can be heated to a temperature above a melt point of the binder 333 and below a melt point of the powdered particles 331. For example, if the binder is a microcrystalline wax with a melt point of 170 degrees Fahrenheit and the powdered particles are mild carbon steel powdered particles with a melt point of over 2000 degrees Fahrenheit, then the powdered particles and the wax can be heated to a temperature of 190 degrees Fahrenheit and combined to form a liquid mixture. In various embodiments, the liquid mixture 330 can also be agitated, to wet substantially all of the powdered particles 331 with the melted binder 333.

In various embodiments, the powdered particles 331 can be combined with the melted binder 333 in various proportions, as will be understood by one of ordinary skill in the art. For example, powdered particles can be combined with melted binder so that, when the liquid mixture forms a solid mixture in a frangible payload, the powdered particles form at least 90 percent of a weight of the frangible payload. As a further example, powdered particles can be combined with melted binder so that the powdered particles form 96 percent of the weight of the frangible payload. These proportions between the powdered particles 331 and the binder 333 can allow the frangible payload to substantially disintegrate when it impacts a stationary solid object, as described in connection with FIG. 1C.

FIG. 3B illustrates a method of settling powdered particles into the frangible slug container 320 according to embodiments of the present disclosure. FIG. 3B illustrates a cross-sectional view. The illustration of FIG. 3B includes the tooling 310 holding the frangible slug container 320 and being vibrated 350. The frangible slug container 320 includes the bottom 321, the payload cavity 325, and the top 329. The liquid mixture 330 includes the powdered particles 331 in the overfill 335 settling 355 toward the bottom 321 of the payload cavity 325. The vibration 350 can be applied to the liquid mixture 330 in various ways, such as, for example, by using a vibration table. The vibration 350 allows gravity to more quickly settle the powdered particles 331 in the liquid mixture 330.

FIG. 3C illustrates a method of floating excess binder from the frangible slug container 320 according to embodiments of the present disclosure. FIG. 3C illustrates a cross-sectional view. The illustration of FIG. 3C includes the tooling 310 holding the frangible slug container 320. The frangible slug container 320 includes the bottom 321, the payload cavity 325, and the top 329. The liquid mixture 330 includes the binder 333 rising 360 to a top 337 of the overfill 335. The binder 333 can rise 360 to the top 337 in various ways. For example, the binder 333 can rise 360 over time as the powdered particles settle due to gravity. Also as an example, the binder can rise 360 in response to a vibration, which can be applied as described in connection with FIG. 3B.

FIG. 3D illustrates a method of removing the overfill 335 from the frangible slug container 320 according to embodiments of the present disclosure. FIG. 3D illustrates a cross-sectional view. The illustration of FIG. 3D includes the tooling 310 holding the frangible slug container 320, and a solid mixture in the payload cavity 325, which is the liquid mixture 330 cooled to a temperature below its melt point and solidified. The frangible slug container 320 includes the bottom 321 and the top 329. A blade 377 of a cutting tool 375 is drawn 370 across the top 312 of the tooling 310, removing the overfill 335 that is outside the payload cavity 325 and forming a finished surface 327 on an open end of the top 329 of the payload cavity 325. The forming of the finished surface 327 provides a frangible slug container 320 filled with a frangible payload, which is a frangible slug, as described in connection with FIG. 1C. The frangible slug of FIG. 3D can be removed from the tooling 310 in various ways, such as by pressing the frangible slug out of the tooling 310.

FIG. 4 illustrates a method of manufacturing a frangible slug according to embodiments of the present disclosure. Block 410 includes heating metallic powdered particles, such as mild steel powdered particles, to form heated metallic powdered particles. At block 420, the method of FIG. 4 includes heating a binder, such as microcrystalline wax, to a melting point for the binder to form melted a melted binder. The method of FIG. 4 also includes, at block 430, combining the heated metallic powdered particles formed at block 410 with the melted binder formed at block 420 to form a liquid mixture, as described in connection with FIG. 3A. Block 440 includes agitating the liquid mixture to wet the heated powdered particles with the melted binder.

At block 450, the method of FIG. 4 includes overfilling a payload cavity of a frangible slug container with the liquid mixture from block 440, as described in connection with FIG. 3A. The method of FIG. 4 also includes, at block 460, vibrating the payload cavity, such as by using a vibrating table as described in connection with FIG. 3B, to more quickly settle the metallic powdered particles down in the overfilled liquid mixture payload of block 450. Block 470 includes floating off an excess portion of the melted binder to a top of the overfilled liquid mixture payload, as described in connection with FIG. 3C.

The method of FIG. 4 further includes, at block 480, cooling the liquid mixture to a temperature below a melt point of the binder, to solidify the liquid mixture and form a solid mixture in the payload cavity. At block 490, the method of FIG. 4 includes removing the overfill from the payload cavity, as described in connection with FIG. 3D, to form a frangible slug with a solid mixture frangible payload, as described in connection with FIG. 1C.

Although specific embodiments have been illustrated and described herein, those of ordinary skill in the art will appreciate that an arrangement calculated to achieve the same results can be substituted for the specific embodiments shown. This disclosure is intended to cover all adaptations or variations of various embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the present disclosure includes other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A frangible slug, comprising:

a substantially cylindrical container with a payload cavity, wherein the payload cavity is defined, at least in part, by an inside surface of the container that includes a circumferential rib, and a frangible payload within the payload cavity, wherein a weight of the frangible slug is within a range of 39.5 grams through 42.0 grams; and the frangible payload including a solid mixture of substantially spherical metallic powdered particles bound in a binder, wherein the frangible payload:

substantially fills the payload cavity of the container and is completely contained within the container;

is exposed to an exterior of the payload cavity within the container only through an open end of the container;

is mechanically retained, at least in part, by the circumferential rib within the payload cavity after firing of the container from a cartridge; and is mechanically retained completely within the container during travel to a solid object and until impact with the solid object causes separation of the frangible payload from the container and damage to an area of the solid object defined by the open end of the container with reduced ricochet.

2. The frangible slug of claim 1, wherein substantially all of the powdered particles have diameters smaller than 250 microns.

3. The frangible slug of claim 2, wherein substantially all of the powdered particles have diameters larger than 125 microns.

4. The frangible slug of claim 3, wherein the powdered particles are mild carbon steel.

5. The frangible slug of claim 1, wherein the binder is a microcrystalline wax.

6. The frangible slug of claim 5 wherein the microcrystalline wax has a drop melt point of at least 170 degrees Fahrenheit.

7. The frangible slug of claim 6, wherein the powdered particles form at least 90 percent of a weight of the frangible payload.

8. The frangible slug of claim 7, wherein the powdered particles form 96 percent of the weight of the frangible payload.

9. A firearm cartridge, comprising:

propellant, configured to accelerate a composite projectile package to a particular muzzle velocity after the cartridge is fired, wherein a weight of the composite projectile package is within a range of 39.5 grams through 42.0 grams; and the composite projectile package including a frangible payload and a container, wherein the frangible payload;

includes a solid mixture of substantially spherical metallic powdered particles bound in a binder;

substantially fills a payload cavity of the container and is completely contained within the container;

is mechanically retained, at least in part, by a circumferential rib within the payload cavity after firing of the container from the cartridge;

is mechanically retained completely within the container during travel to a solid object and until impact with the solid object causes separation of the frangible payload from the container and damage to an area of the solid object defined by an open end of the container with reduced ricochet; and is configured to substantially disintegrate when the package impacts the solid object.

10. The firearm cartridge of claim 9, wherein the frangible payload is configured to substantially disintegrate over an area less than 2 inches in diameter.

11. The firearm cartridge of claim 9, wherein the frangible payload is configured to substantially disintegrate when the package impacts a stationary solid object at a velocity that is substantially equal to the particular muzzle velocity.

12. The firearm cartridge of claim 9, wherein the frangible payload is exposed to an exterior of the payload cavity within the container only through an open end of the container.

13. The firearm cartridge of claim 9, wherein the cartridge is configured as a shotgun shell.

14. The firearm cartridge of claim 9, wherein substantially all of the powdered particles have diameters larger than 125 microns and smaller than 250 microns.

15. A method of configuring a frangible slug, comprising:

forming the frangible slug as a composite projectile package that includes a frangible payload and a container, wherein a weight of the frangible slug is within a range of 39.5 grams through 42.0 grams;

forming the frangible payload as a solid mixture of substantially spherical metallic powdered particles bound in a binder;

substantially filling a payload cavity of the container with the frangible payload such that the frangible payload is completely contained within the container;

mechanically retaining the frangible payload, at least in part, by a circumferential rib within the payload cavity after firing of the container from the cartridge;

mechanically retaining the frangible payload completely within the container during travel to a solid object and until impact with the solid object causes separation of the frangible payload from the container and damage to an area of the solid object defined by an open end of the container with reduced ricochet; and configuring the frangible payload to substantially disintegrate when the package impacts the solid object.

16. The method of claim 15, wherein configuring the frangible payload to substantially disintegrate includes configuring the frangible payload to substantially disintegrate over an area less than 2 inches in diameter.

17. The method of claim 16, wherein configuring the frangible payload to substantially disintegrate over the area less than 2 inches in diameter includes, at least in part, configuring the frangible payload such that the frangible payload is completely contained within the container, and is exposed to an exterior of the payload cavity within the container only through the open end of the container, until the impact with the solid object causes the frangible payload to pass through the open end of the container.

18. The method of claim 17, wherein configuring the frangible slug includes configuring for disabling hardware of a door as a result of impacting the door hardware.

19. The method of claim 18 wherein configuring for disabling the door hardware includes utilizing a weight of the mixture of substantially spherical metallic powdered particles that imparts sufficient kinetic energy to the door hardware when impacting the door hardware.

20. The method of claim 18, wherein configuring for disabling the door hardware includes reducing a likelihood of the frangible payload ricocheting, at least in part, by the frangible payload substantially disintegrating over the area less than 2 inches in diameter.

* * * * *